US006971569B1

(12) United States Patent
Hsu

(10) Patent No.: US 6,971,569 B1
(45) Date of Patent: Dec. 6, 2005

(54) STAPLE EXTRACTOR STRUCTURE

(75) Inventor: Walter Hsu, Tou-Liu (TW)

(73) Assignee: Welter's Co., Ltd., Yunlin Hsien (TW)

( * ) Notice: Subject to any disclaimer, the term of this patent is extended or adjusted under 35 U.S.C. 154(b) by 0 days.

(21) Appl. No.: 10/936,741

(22) Filed: Sep. 9, 2004

(51) Int. Cl.[7] ..... B25C 11/00
(52) U.S. Cl. ..... 227/63; 227/76
(58) Field of Search ..... 227/63, 76; 254/28

(56) References Cited

U.S. PATENT DOCUMENTS 4,513,951 A * 4/1985 Rogers ..... 254/28
5,524,886 A * 6/1996 Kim ..... 463/47.5
5,653,424 A * 8/1997 Khan ..... 254/28
6,513,788 B1 * 2/2003 Ashe ..... 254/28

* cited by examiner

*Primary Examiner*—Louis K. Huynh
*Assistant Examiner*—Chukwurah Nathaniel
(74) *Attorney, Agent, or Firm*—Troxell Law Office, PLLC

(57) ABSTRACT

An improved staple extractor structure includes a movable member having an upwardly-tilting engaging edge properly cut at one side of an engaging cavity concaved upwards at the underside therein, and a U-shaped coupling recess disposed at the front bottom side thereof for retaining an engaging piece with a flat puller fixedly attached thereto. A central limiting groove is properly indented upwards at the front side of the coupling recess thereof, and at preset positions on the inner wall of the engaging cavity thereof is symmetrically disposed a pair of pivoting holes to be mutually registered with pivoting rods of a guide pressing board permitting a push block of the guide pressing board to be precisely located at the limiting groove therein and protruding outwards there-from in match to the flat puller thereof A spring element is respectively attached at the inner wall of the engaging cavity.

4 Claims, 5 Drawing Sheets

STAPLE EXTRACTOR STRUCTURE

BACKGROUND OF THE INVENTION

The present invention is related to an improved staple extractor structure, including a movable member having an engaging cavity concaved upwards at the underside therein, and a U-shaped coupling recess disposed at the front bottom side thereof for retaining an engaging piece with a flat puller fixedly attached thereto. At preset positions on the inner wall of the engaging cavity thereof is symmetrically disposed a pair of pivoting holes to be mutually registered with pivoting rods of a guide pressing board having a protrusive push block extending at the front side thereof in match to the flat puller of the engaging piece thereof. A spring element is respectively attached at the inner wall of the engaging cavity and the upper surface of the guide pressing board by both ends thereof, permitting the rear side of the movable member to be elastically supported upwards thereby; thus, via the design of the movable member and the guide pressing board, the staple extractor of the present invention can be directly and levelly placed on top of paper to remove staples pinned thereon in an easy and convenient manner to achieve the best using condition thereof.

Please refer to FIGS. 1 to 2 inclusive. A conventional staple extractor 10 is made up of upper and lower handles 11, 12 mutually registered in crisscross manner and elastically supported via a spring (without shown in the diagram). At the front end of the upper and lower handles 11, 12 is respectively equipped with a flat puller 13 having a triangular through hole 131 disposed thereon and a flat push section 121. In practical use, the upper and lower handles 11, 12 must be held by a hand before the flat puller 13 attached at the upper handle 12 thereof is pushed to locate at a staple 20 and paper 30 there-between. Then, the upper and lower handles 11, 12 are mutually clamped together, permitting the flat puller 13 to bring upwards the staple 20 till the push section 121 thereof is abutted against the staple 20 as shown in FIG. 2. When the upper and lower handles 11, 12 keep clamping together, the push section 121 thereof will press at the staple 20 towards the through hole 131 thereof to generate a corresponding clamping force relative to that of the flat puller 13 so as to draw upwards the staple 20 out of the paper 30 thereof.

There are some drawbacks to the conventional staple extractor above. Most of all, the staple extractor 10 cannot be located levelly onto the paper 30, and the upper and lower handles 11, 12 thereof must be securely held by hands in advance before mutually clamped together to remove the staple 20 thereby. Thus, the conventional staple extractor thereof is rather inconvenient and slow in practical use.

SUMMARY OF THE PRESENT INVENTION

It is, therefore, the primary purpose of the present invention to provide an improved staple extractor structure, including a movable member, a guide pressing board, a spring element, and an engaging piece wherein, via the design of the movable member and the guide pressing board, the staple extractor of the present invention can be directly and levelly placed on top of paper to remove staples pinned on the paper without hands holding on thereto, facilitating an easier and convenient application and achieving the best using condition of the present invention.

DETAILED DESCRIPTION OF THE PREFERRED EMBODIMENTS

Figure 1:
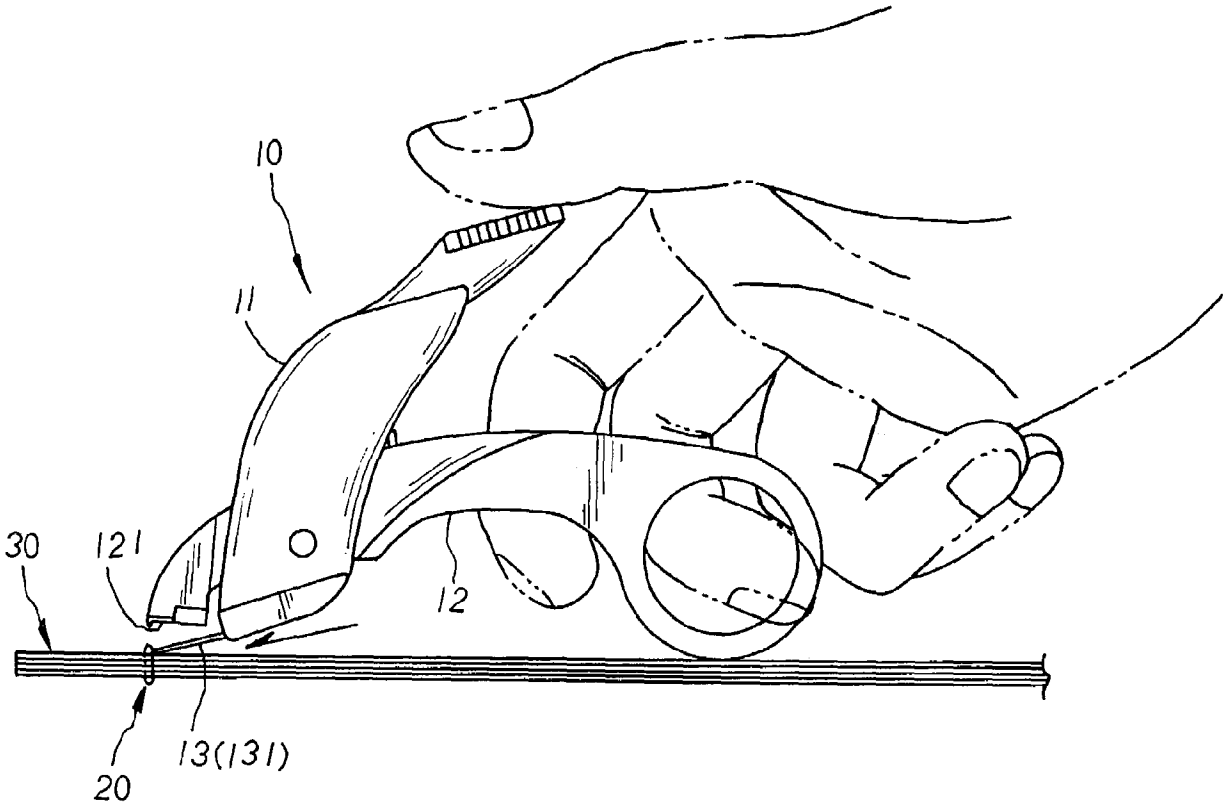
FIG. 1 PRIOR ART
FIG. 1 is a diagram showing a conventional staple extractor in practical use.
Figure 2:
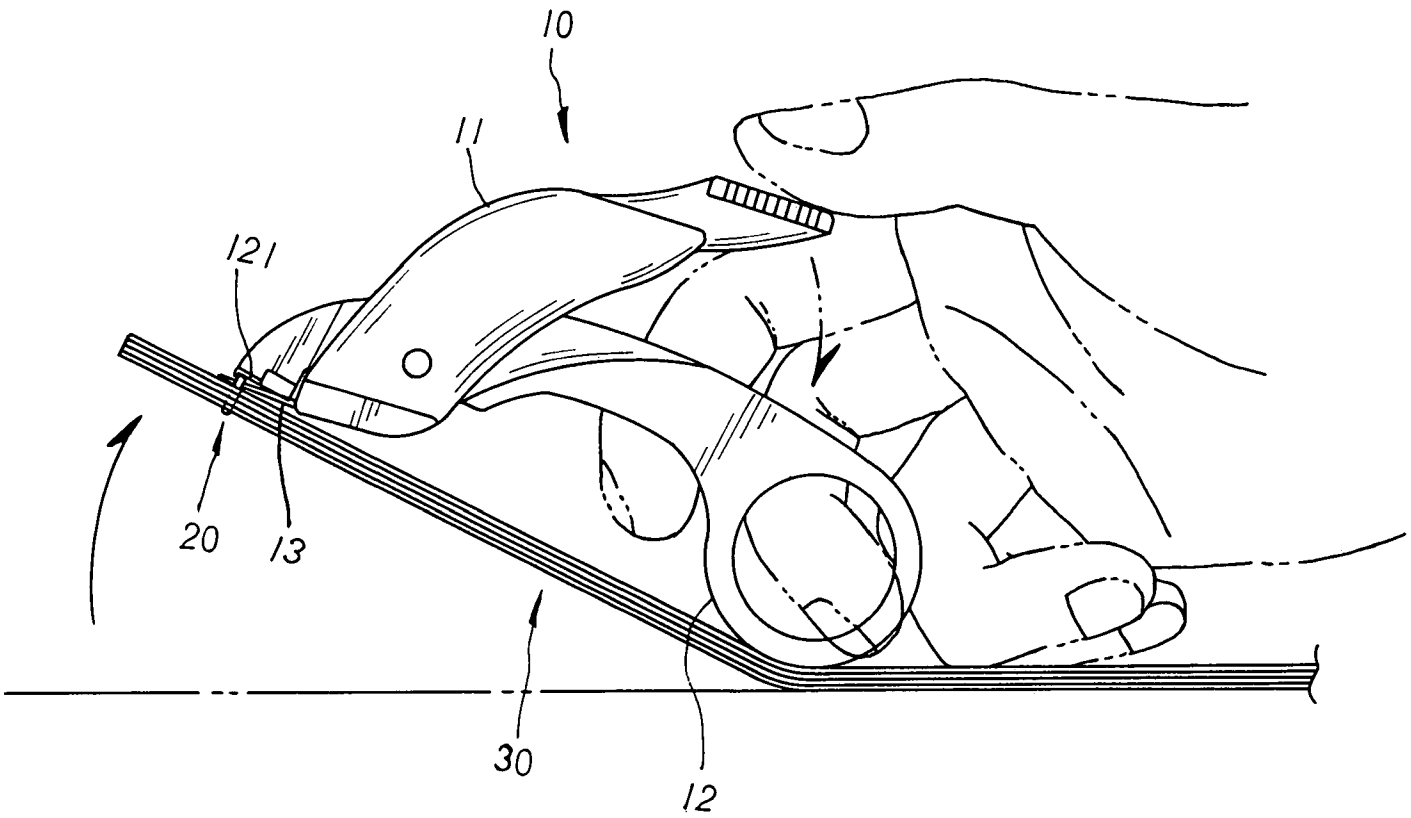
FIG. 2 PRIOR ART
FIG. 2 is a diagram showing the conventional staple extractor applied to remove a staple in practical use.
Figure 3:
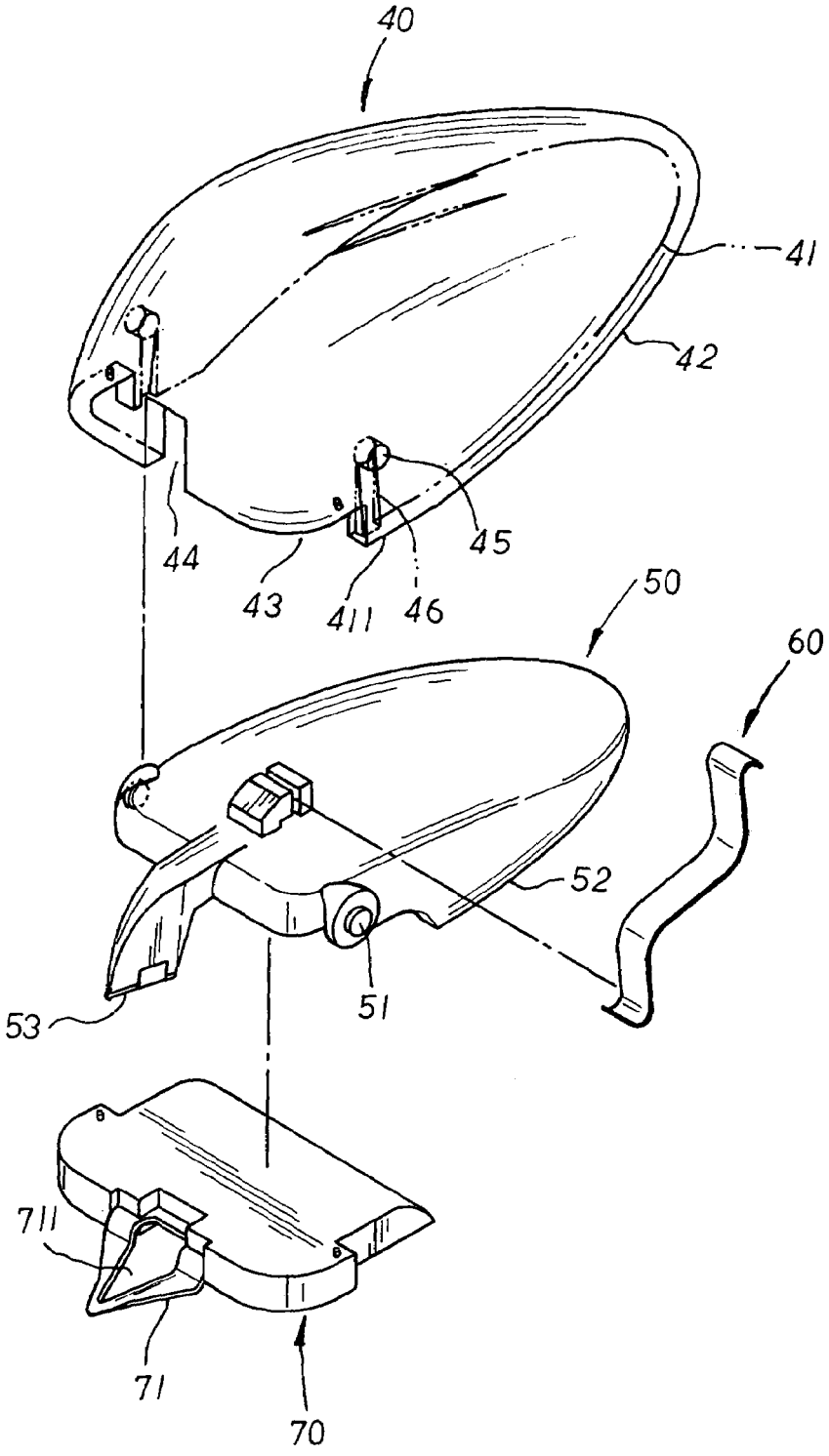
FIG. 3 is a perspective exploded view of the present invention.
Figure 4:
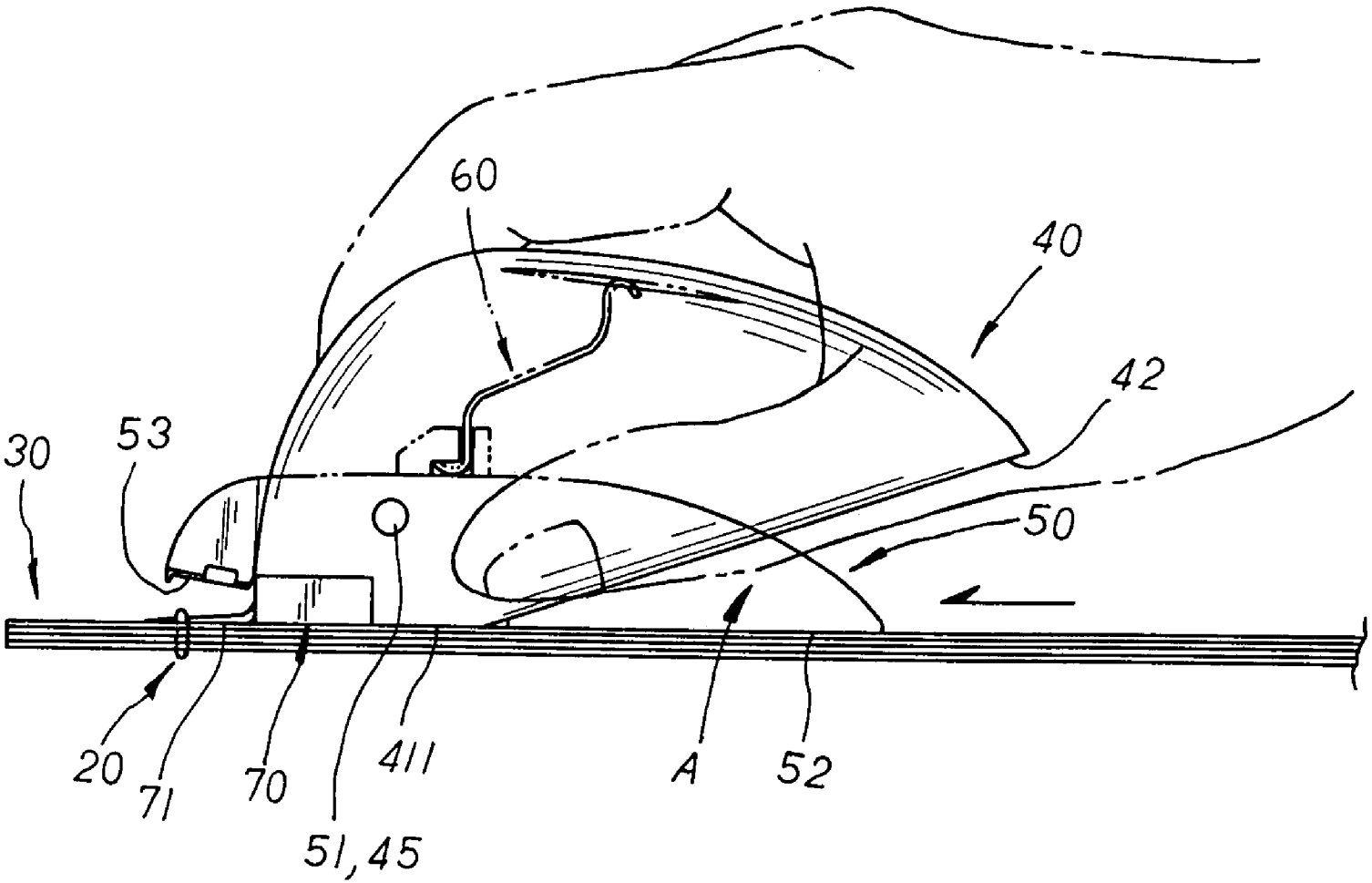
FIG. 4 is a diagram showing the operation of the present invention in assembly.

Please refer to FIG. 3. The present invention is related to an improved staple extractor structure, including a movable member 40 made up of an engaging cavity 41 concaved upwards at the underside therein, an upwardly-tilting engaging edge 42 properly cut at one side of the opening of the engaging cavity 41 thereof, a U-shaped coupling recess 43 extending from edge to edge at the front bottom side thereon, and a central limiting groove 44 properly indented upwards at the front side of the coupling recess 43 thereof. At preset positions on the inner wall of the engaging cavity 41 thereof is symmetrically disposed a pair of pivoting holes 45 each communicating with a vertical guide track 46 extending downwards at the bottom side thereof. A guide pressing board 50 is provided with a pair of symmetrical pivoting rods 51 to be led upwards via the vertical guide tracks 46 till precisely registered with the pivoting holes 45 for locating the guide pressing board 50 at the engaging cavity 41 therein. A spring element 60 is respectively attached at the inner wall of the engaging cavity 41 and the upper surface of the guide pressing board 50 by both ends thereof, permitting the rear side of the movable member 40 elastically supported upwards by the spring element 60 thereof. And the guide pressing board 50 is provided with a flat abutting area 52 extending at one lateral edge of the bottom side thereon and levelly aligned with an abutment facet 411 of the engaging cavity 41 thereof to define a movement space A with the adjacent engaging edge 42 thereof as shown in FIG. 4. The guide pressing board 50 also includes a protrusive push block 53 disposed at the front side thereof to be precisely located at the limiting groove 44 of the movable member 40 therein and extending outwards there-from. An engaging piece 70 is securely fixed to the coupling recess 43 of the movable member 40 and integrally combined therewith into one unit. A flat puller 71 with a triangular through hole 711 defined thereon is fixedly attached at one edge of the engaging piece 70 and correspondingly matched to the push block 53 of the guide pressing board 50 thereof. The flat puller 71 is properly bent downwards to form a plane surface at the bottom thereon.

Figure 5:
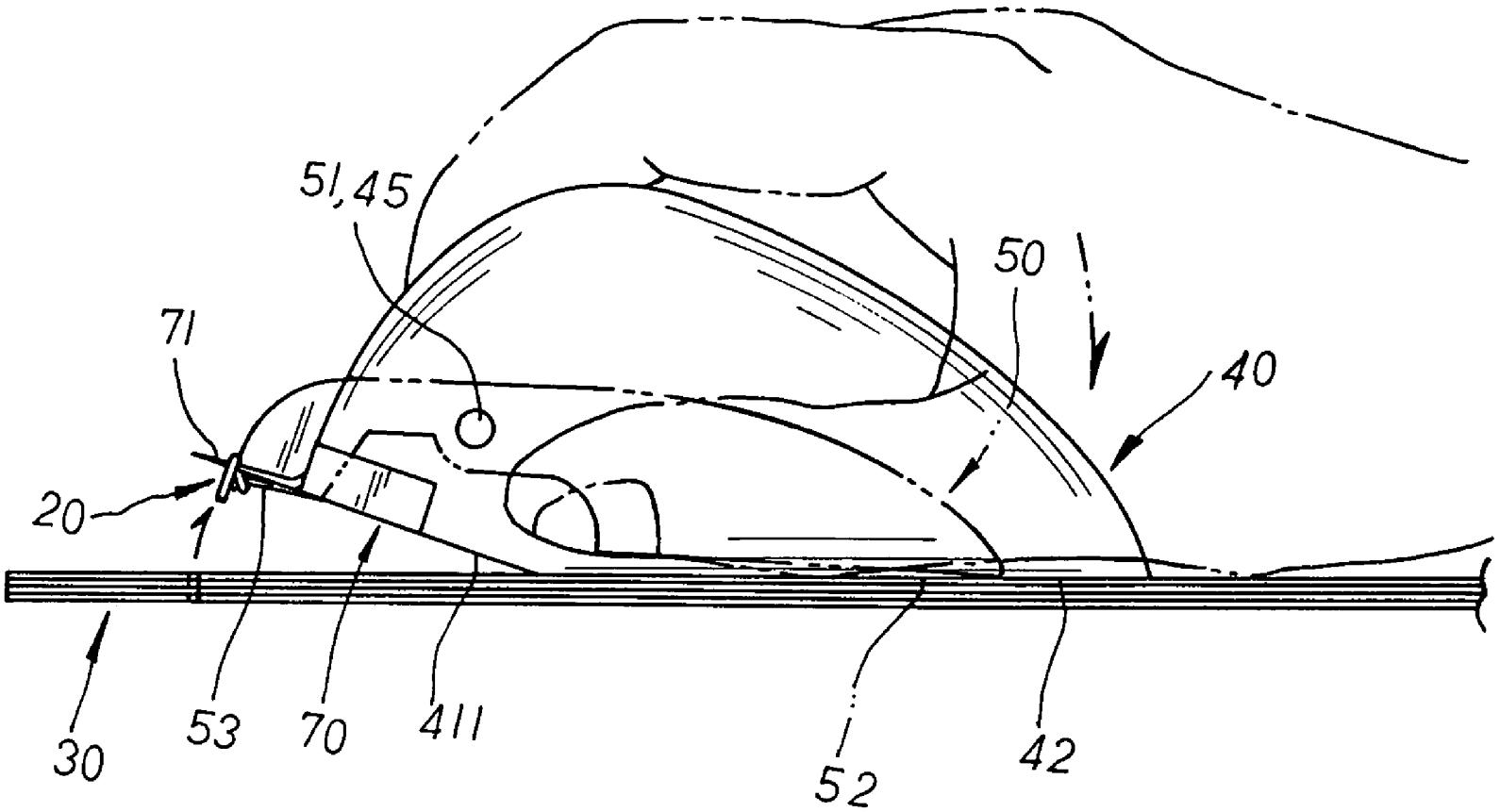
FIG. 5 is a diagram showing the present invention applied to remove a staple from paper in practical use.

Please refer to FIGS. 4 to 5 inclusive. In practical use, the staple extractor of the present invention is placed onto the upper surface of paper 30 with the flat abutting area 52 of the guide pressing board 50, the abutment facet 411 of the engaging cavity 41, and the engaging piece 70 thereof levelly located on top of the paper 30 thereof. The staple extractor is then moved towards a staple 20 pined at the paper 30 thereon, and the flat puller 71 thereof is levelly guided and forced between the staple 20 and the paper 30 thereof, securely preventing the flat puller 71 from tearing off the paper 30 thereof. The movable member 40 is then pressed by the rear side thereof to descend downwards at the movement space A therein, actuating the pivoting holes 45 to rotate downwards along the pivoting rods 51 thereof and synchronically compress tight the spring element 60 therewith as shown in FIG. 5. When the engaging edge 42 of the engaging cavity 41 descending downwards at the movement space A therein completely touch and cover the upper surface of the paper 30 thereof, the abutting facet 411 along with the engaging piece 70 mounted at the coupling recess 43 therein will be pivotally bent upwards and ascend at the other side relative to the descending the engaging edge 42 thereof. Meanwhile, the flat puller 71 can draw upwards the staple 20 accordingly till the middle section of the staple 20 is stopped by the push block 53 pressing the staple 20 towards the triangular through hole 711 to generate a clamping force relative to that of the flat puller 71 so as to draw out the stapler 20 from the paper 30 in an easy and smooth manner. Thus, via the design of the movable member 40 and the guide pressing board 50 thereof, the staple extractor thereof can be directly and levelly applied on top of the paper 30 and stably located stably thereon without hands holding on thereto when the movable member 40 is pushed downwards to remove the staple 20 pinned onto the paper 30, facilitating an easier and more convenient application to achieve the best using condition of the present invention thereof.

What is claimed is:

1. A staple extractor structure for removing a staple comprising:

a) a movable member movable between first and second positions and having:

i) an engaging cavity having a concave shape;

ii) an upwardly-tilting engaging edge located on an outer periphery of a rear of the engaging cavity;

iii) an abutment facet located on an outer periphery of a front of the engaging cavity;

iv) a coupling recess extending along a bottom of the front thereof;

v) a central limiting groove protruding upwardly from a front side of the coupling recess; and vi) two pivoting holes located on opposite sides of an interior wall of the engaging cavity;

b) a guide pressing board pivotally located within the engaging cavity and having:

i) two pivoting rods, one of the two pivoting rods is inserted into each of the two pivoting holes;

ii) a flat abutting area located on a bottom side thereof and aligning with the abutment facet of the engaging cavity when the movable member is located in the first position and aligning with the upwardly-tilting engaging edge when the movable member is located in the second position; and iii) a protrusive block located on a front thereof and extending outwardly from the central limiting groove;

c) a spring element having a first end connected to an upper surface of the guide pressing board and a second end engaging the interior wall of the engaging cavity, a rear of the movable member being pressed upwardly by the spring element; and d) an engaging piece having a flat puller fixedly connected to the coupling recess of the movable member, the engaging piece and the movable member are combined a one unit, wherein, when the movable member is located in the first position, the flat puller is inserted under the staple, and, when the movable member is moved to the second position, the staple is lifted upwardly by the flat puller.

2. The staple extractor structure according to claim 1, wherein the flat puller is bent downwardly and having a bottom surface aligning with abutment facet of the engaging cavity.

3. The staple extractor structure according to claim 1, wherein the movable member having two guide tracks, one of the two guide tracks extending downwardly from each of the two pivoting holes.

4. The staple extractor structure according to claim 1, wherein the coupling recess extending from a first opposing edge to a second opposing edge of the movable member and having a U-shape.

* * * * *